United States Patent [19]

Aizawa

[11] Patent Number: 4,551,029

[45] Date of Patent: Nov. 5, 1985

[54] ELECTRONIC TIMEPIECE WITH A SOUND GENERATOR

[75] Inventor: Hitomi Aizawa, Suwa, Japan

[73] Assignee: Kabushiki Kaisha Suwa Seikosha, Tokyo, Japan

[21] Appl. No.: 648,208

[22] Filed: Sep. 7, 1984

Related U.S. Application Data

[63] Continuation of Ser. No. 277,292, Jun. 25, 1981, abandoned.

[30] Foreign Application Priority Data

Jun. 26, 1980 [JP] Japan ..... 55-87057
Jun. 27, 1980 [JP] Japan ..... 55-87482

[51] Int. Cl.[4] ..... G04B 21/00; G10H 1/00
[52] U.S. Cl. ..... 368/273; 84/1.01
[58] Field of Search ..... 368/75, 272, 273; 84/1.01, 1.03, 470 R, 464 R

[56] References Cited

U.S. PATENT DOCUMENTS 4,010,667 3/1977 Kniepkamp ..... 84/1.03
4,213,372 1/1980 Sasaki et al. ..... 84/470 R
4,276,586 5/1981 Uchino et al. ..... 368/73

*Primary Examiner*—Vit W. Miska
*Attorney, Agent, or Firm*—Blum, Kaplan, Friedman, Silberman & Beran

[57] ABSTRACT

A sound generator including a note generating circuit for outputting a sequence of note signals corresponding to audible notes, an acoustic transducer receiving said note signals and outputting audible notes, memory means for storing data characterizing a note signal and including an inhibit signal, inhibit means, and means responsive to the inhibit signal from the memory means for transmitting said inhibit signal to said inhibit means to block passage of the terminal portion of the note signal to the transducer means.

14 Claims, 6 Drawing Figures

ELECTRONIC TIMEPIECE WITH A SOUND GENERATOR

This application is a continuation of application Ser. No. 277,292 filed June 25, 1981, now abandoned.

BACKGROUND OF THE INVENTION

This invention relates generally to an electronic timepiece of the type having an audible alarm and more particularly to an electronic timepiece having a sound generator playing a program of notes to produce a melody. In electronic tone generators of the type used, for example, in an electronic calculator, a watch, or a music box, etc., there is the difficulty that no pause is provided between notes as they are produced. This makes it difficult to distinguish between long and short notes when notes of the same frequency follow one another. When wave shaping is used on the frequency signals of the notes, it is easier to distinguish between the notes but it is very difficult to distinguish the length of a note. Such melody generating systems, as a result, are unable to generate an articulate and lilting melody. In particular, a march cannot be played. In summary, it is difficult to distinguish between a long note and a plurality of short notes of the same frequency because there is no pause between the notes. Further, in a melody some rests are needed and these cannot be readily provided.

What is needed is a sound generator for small devices such as calculators and electronic timepieces which provides well articulated musical notes by providing a pause between each note of a melody. It is also desirable where a visual display is utilized in conjunction with the sound generator that there be synchronization between the visual display and the audible sound.

SUMMARY OF THE INVENTION

Generally speaking, in accordance with the invention, an electronic timepiece with a sound generator especially suitable for generating well articulated notes in a melody is provided. A tone generator using a variable, programmable divider circuit for consecutively outputting notes to produce a melody, provides a pause which distinguishes between the notes even when consecutive notes are identical. A visual display changes with each consecutive note and rests are provided in the music. Data for generating notes is stored in consecutive addresses of a memory and read-out in order so as to program a variable divider and produce notes in sequence. One bit stored in data for each note determines that a pause be provided between consecutive notes. When the pause bit is present, the note signal frequency from the variable divider is prevented from driving the acoustical output circuit, for example, a loudspeaker. A rest period is provided as needed in a melody by blocking the audible output of the sound generator for the desired period of time.

Accordingly, it is an object of this invention to provide an improved electronic timepiece with a sound generator producing well articulated melodies.

Another object of this invention is to provide an improved electronic timepiece with a sound generator which outputs notes having a pause between each consecutive note.

A further object of this invention is to provide an improved electronic timepiece with a sound generator which provides for rests during a melody.

Still another object of this invention is to provide an improved electronic timepiece with a sound generator and a visual display providing visual actuations in sychronization with the musical notes.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
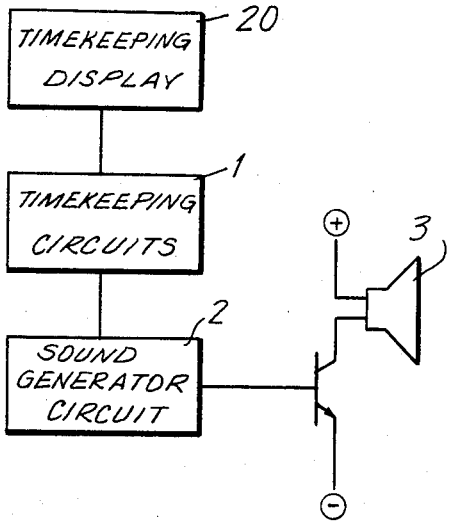
FIG. 1 is a block circuit diagram of a timepiece with a note generating capability in accordance with this invention.
Figure 3:
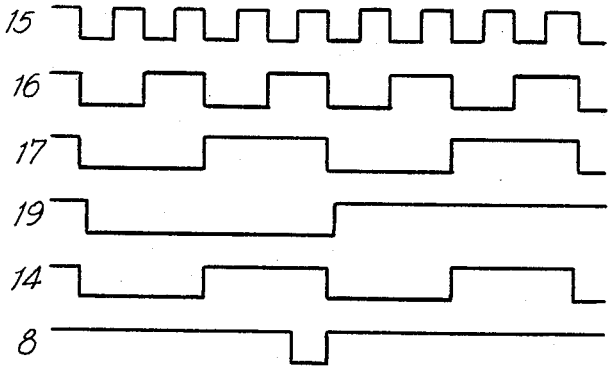
FIG. 3 is timing waveforms associated with the circuit of FIG. 2.
Figure 2:
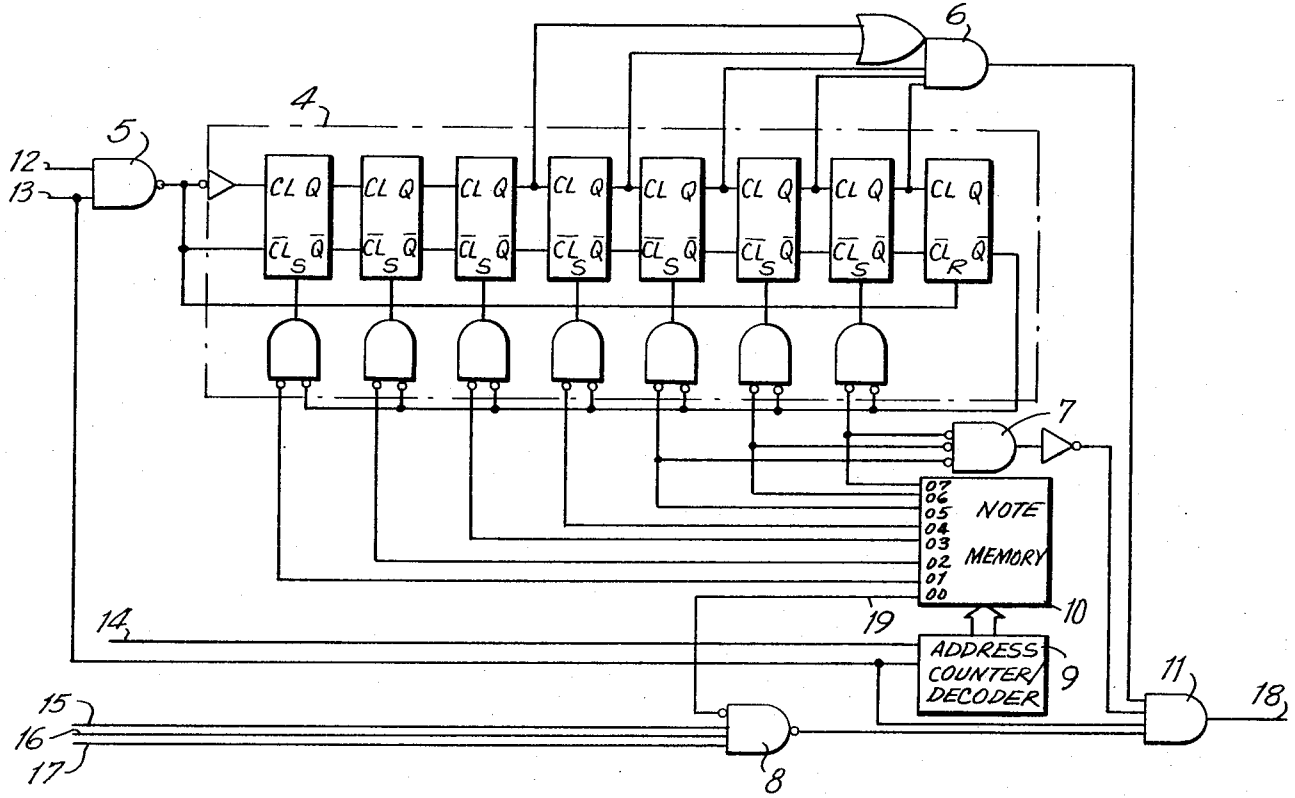
FIG. 2 is a circuit diagram of the sound generator circuit of FIG. 1.

With reference to the FIGS. 1–3, conventional timekeeping circuits 1 output a signal 13 to a sound generator circuit 2 when the actual time coincides with a preselected time. For example, signal 13 can be used to indicate that the acual time is coincident with a preselected alarm time where the sound generator circuit 2 provides an audible alarm signal. After receiving the signal 13 from the timekeeping circuit 1, the sound generator circuit 2 outputs a signal 18 to a transistor in series with an electro-acoustical output device 3, for example, a loudspeaker.

The timekeeping circuits 1 and timekeeping display (not shown) are conventional and not a novel portion of this invention. Accordingly, these elements are not described in any greater detail herein. Nevertheless, it should be understood that the timekeeping circuits provide a high frequency source of signals which are divided down to provide signals of lower frequency as used in the sound generator circuit 2 and more fully described hereinafter.

The sound generator circuit 2 of FIG. 1 is shown in greater detail in FIG. 2. Therein, the coincidence signal 13, indicating that it is time to activate the sound generator circuit 2, is inputted to a NAND gate 5. Also inputted to the NAND gate 5 is a signal 12 of 65,536 Hz. This high frequency signal enters a programmable or variable divider 4 comprised of a plurality of divider stages which reduce the frequency by $\frac{1}{2}$ in each successive stage in the known manner. Outputs of the variable divider 4 pass through a combination OR-AND gate 6. The frequency which is outputted from the gates 6 depends upon the number of stages which are active in the programmable divider 4 and as explained more fully hereinafter, this frequency is determined by data stored in a note memory 10. The frequency output signal from the gates 6 is the frequency or pitch of the sound which is emitted from the electro-acoustical speaker 3. In this embodiment, for the sake of an example, the signals 14,15,16 and 17 respectively are periodic signals of 8,32,16 and 8 Hz.

The sound generator circuit 2 also includes an address counter/decoder 9, and gates 7, 8 and 11. Additional gates having inverted inputs connect between the set terminals of the divider stages and the outputs of the note memory 10.

The periodic signal of 65,536 Hz, which is produced by doubling the frequency of an oscillator in the timekeeping circuits 1, is applied to the NAND gate 5. The note memory circuit 10, which may be a read-only-memory (ROM), stores data of dividing ratios for the variable or programmable divider circuit 4. The note memory 10 also provides data for inhibiting operation of the acoustic transducer 3 by control of the transistor base.

When the actual time is coincident with the preselected time in the timekeeping circuits 1, the signal 13 to the sound generator circuit 2 is high or "1". The signal 13 is inputted to the NAND gate 5 and to the address counter/decoder 9 and the content of an address in the note memory 10 selected by the counter decoder 9 is outputted on the memory output terminals. Data of divider ratios are outputted at regular intervals synchronized by the periodic signal 14 of 8 Hz which is inputted to the address counter/decoder 9. Thus, data of the dividing ratio, which is read from the note memory 10 is applied to the divider stages of the melody generator, that is, the variable divider 4, eight times per second.

When the input 13 from the timekeeping circuits 1 to the NAND gate 5 is high, the signal 12 of 65,536 Hz passes through the NAND gate 5 and is inputted to the variable divider 4. Therein, the high frequency signal is divided down in accordance with the dividing ratio data which is concurrently outputted from the note memory 10. The output of the variable divider 4 passes through the OR-AND gate combination 6 and this signal represents a note signal having a frequency dependent upon the data in the note memory 10. Accordingly, as many as eight different notes per second can be outputted from the gate combination 6 in response to the 8 Hz signal 14 inputted to the address counter/decoder 9.

The signal from the gate combination 6 passes through an inhibit gate 11 in order to actuate the transistor in series with the loudspeaker 3. The gate 11 requires an additional three inputs so as to transmit the signal from the gate combination 6. One input to the gate 11 is outputted by the gate 8 which itself has four inputs, that is, signals 15,16,17 and 19. The signal 19 is an inhibiting signal which is part of the data stored in each address of the note memory 10 along with the data of dividing ratio. As seen in the waveforms of FIG. 3, when the signal 19 is low, the output of the gate 8 is high except at the end portion of the low signal 19 when the remaining inputs 15,16,17 to the gate 8 are coincidentally high. At that time, the output of the gate 8 is low.

Another input to the gate 11 is the signal 13 indicating coincidence between the actual time and the preselected time in the timekeeping circuits 1. Another input to the gate 11 represents the signals out of the note memory 10 on the trerminals $O_7$, $O_6$, and $O_5$, that is, the three higher bits outputted from the memory 10.

As stated above, when the actual time is coincident to the preselected time in the timekeeping circuits 1, the signal 13 is high and the data contents of the memory 10 is read out in order. Read out is synchronized by a periodic signal 14 of 8 Hz inputted to the address counter/decoder 9 which changes the addresses consecutively for read out from the note memory 10. Data of the dividing ratio which is read from the memory 10 is applied to the stages of the melody generator, that is, the variable divider 4. While the input 13 to the NAND gate 5 is high, a signal 12 of 65,536 Hz passes through the NAND gate 5 and is inputted to the variable divider 4. A frequency signal which has been divided down in accordance with the dividing ratio data outputted from the memory 10 is outputted from the OR-AND gate combination 6. This frequency signal is in the audible frequency range and is the note, for example, in a melody.

When the inhibiting data from the lowest bit output of the note memory 10 is low on line 19, an output 8 (FIG. 3) from the gate 8 is input to the gate 11. Thus, the note frequency signal from the gate combination 6 which has been provided in accordance with the dividing ratio data from the note memory 10, is inhibited, that is, prevented from passing through the inhibiting AND gate 11 while the logical level of the signal 8 is "0". The duration of the inhibited period, in this example, is 15.6 milliseconds, that is, one-half of the period of the 32 Hz signal.

The acoustic transducer 3 of FIG. 1 is driven in response to the signal 18 from gate 11. Thus, a note of a different pitch or frequency may be outputted for each address in the note memory 10 as selected by the address counter/decoder 9. The timing for outputting of the memory data from the memory 10 is synchronized by the signal 14 of 8 Hz which has the same period as the timing of the signal 19 when it is low as shown in FIG. 3. However, at the end of one period of an 8 Hz signal, the address of the memory 10 for read out is changed. The dividing ratio may change so that a new note having a different frequency or pitch is produced. As a result of the interaction of the four signals 14,15,17, and 19 in the gate 8, the inhibit signal 8 is outputted just before the end of a note, that is, just before new data is read from the note memory 10. Therefore, when the inhibiting data is written in the note memory 10 together with the dividing ratio data, a pause is placed in between the notes which are being synchronized by the signal 14. On the other hand, when inhibiting data is not written in memory, that is, when the signal 19 remains high during production of a note, a pause is not put into the music because there is no low portion in the signal 8.

In this way it is possible to connect together notes produced consecutively without a pause between them. When the consecutive notes are of the same pitch or frequency, then a note of longer duration than $\frac{1}{8}$ seconds is produced.

When the signals of the three higher bits, that is, terminals $O_7$,$O_6$,$O_5$, from the note memory 10 are low, another inhibiting signal is outputted from the gate 7 and note signals from the gate combination 6 are inhibited from passing through the gate 11. Thus, no sound will be produced during that period and the inhibiting signal provides a rest in the musical score. This rest is also outputted in synchronization with the signal 14 in the same manner as is the output of a note. Therefore, when a long rest is needed, it is only required that data for a long rest be written to an address, or addresses in the note memory 10.

Thus, in a timepiece with a sound generator in accordance with this invention, musical melodies can be produced at a preselected time with the music having a pause between the notes and including rest periods as required by the music. These effects are simply provided by means of the inhibiting gate circuit 11 and by storing the required inhibit data in the note memory along with data for the note frequencies. This is very effective in generating a pleasing musical sound and is accomplished with a simple circuit construction.

Figure 4:
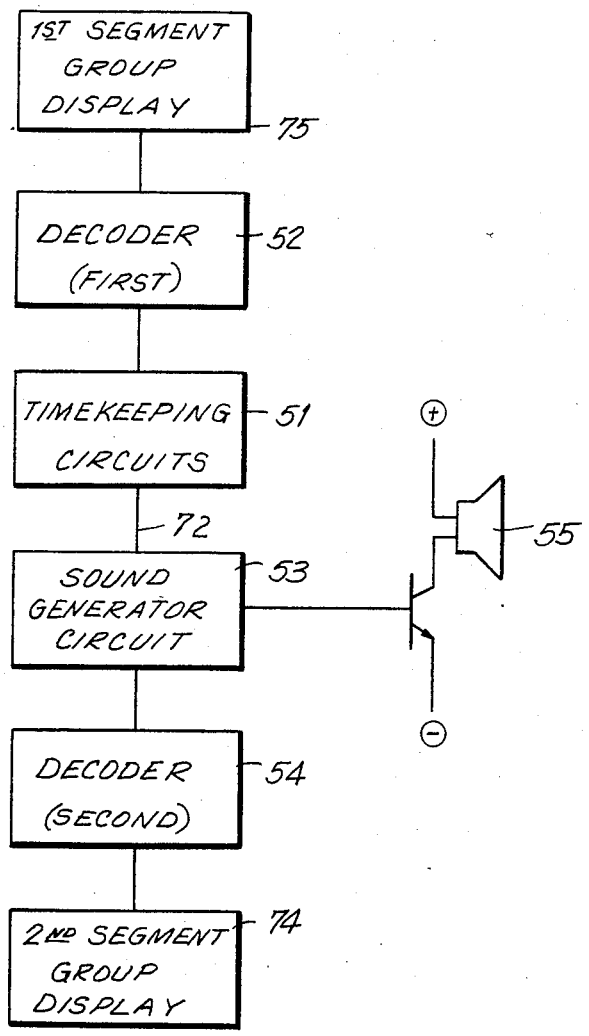
FIG. 4 is an electronic timepiece with a sound generator and display in accordance with this invention.
Figure 6:
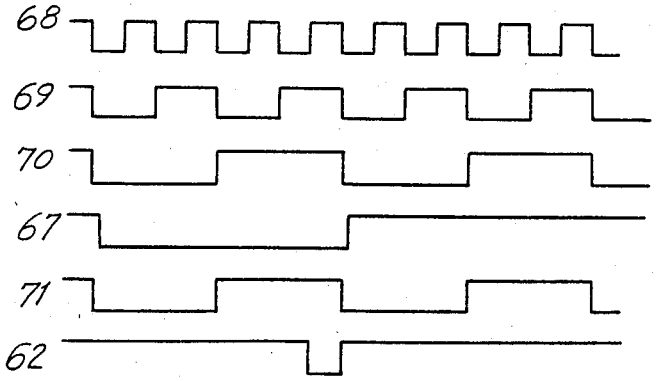
FIG. 6 is waveform diagrams associated with the circuit of FIG. 5.
Figure 5:
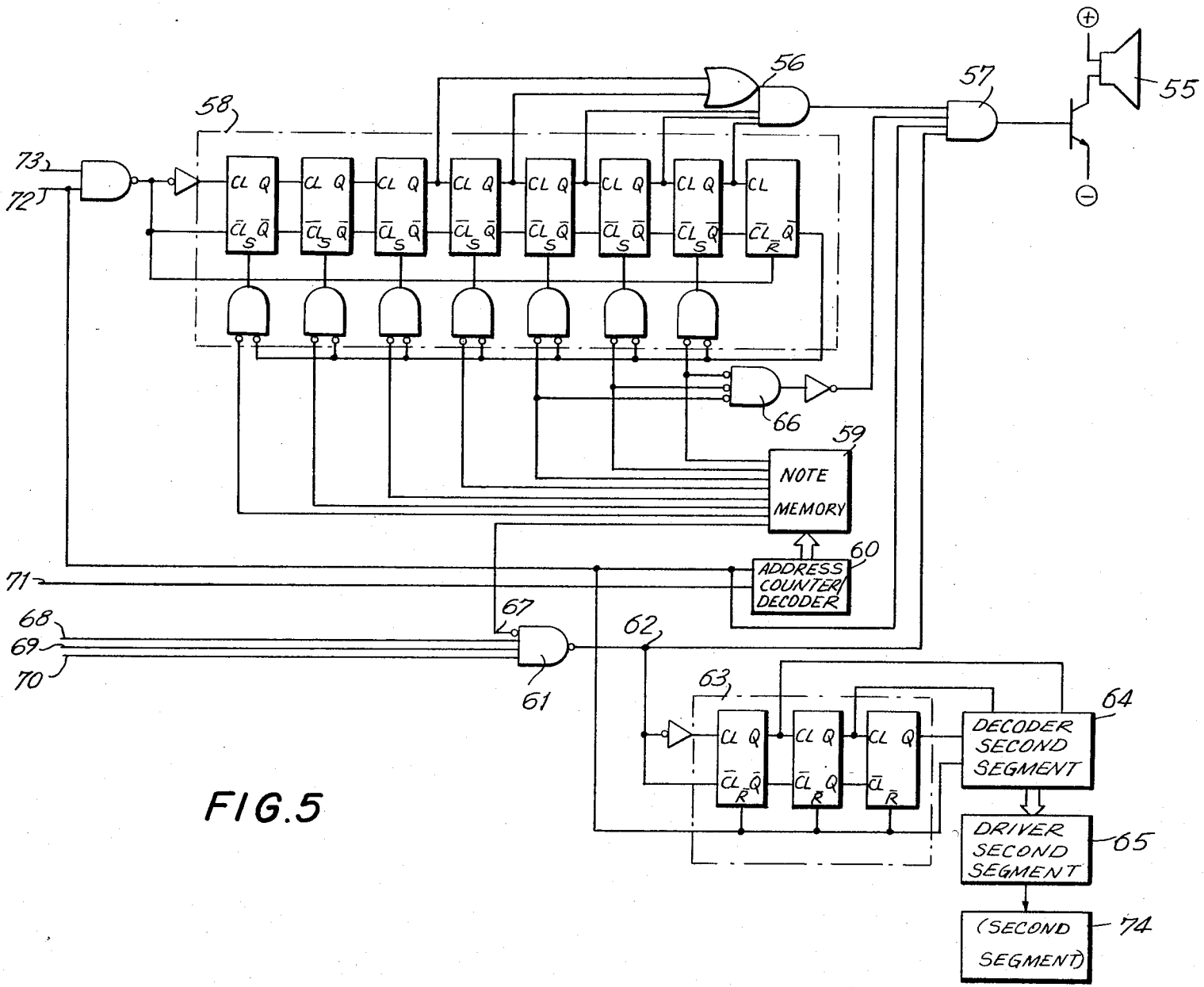
FIG. 5 is a curcuit diagram of the sound generator circuit and display driving circuit of FIG. 4.

With reference to FIGS. 4–6, an alternative embodiment in accordance with this invention is described. In this embodiment an electronic timepiece not only provides music in place of a simple alarm sound, but also a "moving object" is displayed, acting in synchronization with the music. Thereby, a pleasant alarm is emitted and the user is given further pleasure by the sight of display motion. FIG. 4 is a block diagram of a timepiece with a sound generator and a synchronized display.

The timekeeping content of a timekeeping circuit 51 is inputted to a first decoder driving circuit 52 which drives a first segment group 75 of a visual display whereby timekeeping data is displayed by the first segment group 75 in the conventional manner which needs no further description herein. Additionally, a signal 72 for triggering a sound generating circuit 53 at an optionally preselected time is inputted from the timekeeping circuit 51 and as a result a melodic sound is outputted from an acoustic transducer 55. Simultaneously, a second decoder driving circuit 54 for driving a second segment group 74 is driven. Thereby, the second segment group 74 provides a visual display which is synchronized with the melody sounds which are played by the acoustic transducer 55.

The sound generating circuit 53 and the second decoder driving circuit 54 shown in FIG. 4 are shown in greater detail in FIG. 5 and are now described. The sound generator circuit 53 is similar to the sound generator circuit 2 of FIG. 1 in its construction and performance. At a preselected time, e.g., the selected alarm setting, a signal 72 from the timekeeping circuit 51 is high or "1". Then note data which is previously stored in a note memory 59, is read out by means of an address counter/decoder 60. The address counter/decoder 60 is driven in response to an address signal 71, which, for the sake of an example, is a periodic signal of 8 Hz. The data output from the note memory 59 is inputted to a variable divider 58, which as described above, is the generator of notes of different frequencies in accordance with division ratio data stored in the memory 59.

In the variable divider 58, a periodic signal 73 of 65,536 Hz is inputted. The dividing ratio of the programmable divider 8 is variable by presetting and storing note data in the memory circuit 59. A note signal of desired frequency, that is, pitch, is formed by means of the AND/OR gate combination 56 and this signal is inputted to an inhibiting gate 57.

Not only the note data is stored in the note memory circuit 59, but also data for inhibiting a note signal for a short interval of time is stored in the memory 59. This is an inhibit signal 67.

The inhibit signal 67 is inputted to a gate 61 along with signals 68,69 and 70 which have frequencies of 32,16 and 8 Hz, respectively. The signal 62 (FIG. 6) is the output of the gate 61 in response to the four signals 67–70. When the signal 62 is low, the note signal from the gate combination 56 is inhibited from passing through the inhibiting gate 57 by application of the signal 62 as an input to gate 57. Therefore, a pause occurs in between the notes, as described above with respect to the embodiment of FIGS. 1–3. Also, as in the embodiment described above, notes can be connected together without a pause by maintaining the inhibit signal 67 at a high level during a note.

Additionally, another signal for inhibiting the note signal is also selectively produced by means of a gate 66. This signal from the gate 66 is outputted when the logical level of three bits outputted from the memory circuit 59 is low. As described above, this signal from the gate 66 provides a rest in the melody.

The signal 62 for putting a pause between the notes of the melody is also inputted to an animation driving counter 63, which utilized for driving the second segment display group 74. The output of the counter 63 changes whenever the signal 62 is outputted. That is, the signal 62 occurs at the completion of each note in the melody as described above. Then, an output signal from the animation driving counter 63 is inputted to the second segment decoder 64 and is transformed to a predetermined signal format. The transformed output signal is inputted in the known manner to a second segment driving circuit 65 and the second segment group 74 is driven.

As stated above, the second segment group 74 is driven in response to the signal 62 for putting a pause in between notes of a melody. As notes are emitted from the acoustic transducer 55, a "moving" object can be displayed in synchronism with the melody which is being played by the transducer 55. For example, a face of a person or animal may be shown on the display with the left and right eye being alternately illuminated in time with the music.

Accordingly, this second embodiment, in addition to driving a note generating circuit to produce a melody, provides visual pleasure by adding a circuit for driving a simple second display segment group.

It will thus be seen that the objects set forth above, among those made apparent from the preceeding description, are efficiently attained and, since certain changes may be made in the above constructions without departing from the spirit and scope of the invention, it is intended that all matter contained in the above description or shown in the accompanying drawings shall be interpreted as illustrative but not in a limiting sense.

It is also to be understood that the following claims are intended to cover all of the generic and specific features of the invention herein described, and all statements of the scope of the invention which, as a matter of language, might be said to fall therebetween.

What is claimed is:

1. A sound generator comprising:

a note generating circuit for outputting a sequence of note signals of the same or different frequencies, each frequency corresponding to an audible note;

an acoustic transducer having said note signals as an input and having audible notes as an output;

memory means for storing data characterizing a note signal along with data characterizing an associated inhibit signal, said stored note data being read out to said note generating circuit in a regular sequence for generating said sequence of the note signals;

inhibit means responsive to at least one inhibit signal for selectively blocking passage of note signals from said note generating circuit to said acoustic transducer; and means responsive to inhibit signal data, read from said memory means at the same time as the corresponding note data, for transmittal of an inhibit signal to said inhibit means to block passage of a terminal portion of the note signal to the transducer means, whereby the sound of a second audible note is made distinguishable from a first audible note by the termination of the first audible note.

2. A sound generator as claimed in claim 1, wherein the blocked terminal portion resulting from each inhibit signal is of the same duration.

3. A sound generator as claimed in claim 1 wherein data characterization of a rest signal is stored in the memory means, and further comprising:

rest signal generating means responsive to said rest signal data for transmittal of a rest signal to the inhibit means as a signal inhibit signal.

4. A sound generator as claimed in claim 1, wherein said memory means stores said data characterizing said note signals and said inhibit signals at the same address, each address is read out in sequence at regular intervals, and the data from each address is read until the next address is read.

5. A sound generator as claimed in claim 1, wherein said inhibit means includes an AND gate between said note generator circuit output and said transducer, said AND gate having an input for, and being adapted to, respond to inhibit data read from said memory.

6. A sound generator as said in claim 5 and further comprising:

means for timing the occurrence and duration of said blocked portion of said note signals supplied to said transducer.

7. A sound generator as claimed in claim 6, wherein the means for timing is a gate having plurality of inhibits, one input being inhibit data read from said memory means and at least one other inhibit being a periodic signal.

8. A sound generator as claimed in claim 7, and further comprising timekeeping circuits, said timekeeping circuits providing a high frequency standard signal to said note generating circuit, said note generating circuit including a programmable divider, said programmable divider dividing down said high frequency signal by selective division ratios to project selected notes in response to said note data in said memory.

9. A sound generator as claimed in claim 8, wherein said timekeeping circuits include a coincidence detector, said coincidence detector outputting an actuation signal upon the coincidence between actual time measured by said timekeeping circuits and a preselected time stored in said timekeeping circuits, said actuation signal being another input to said inhibit means AND gate, whereby a musical alarm may be provided at said preselected time.

10. A sound generator as claimed in claim 1, 2, or 4 and further comprising timekeeping circuits, said timekeeping circuits providing a high frequency standard signal to said note generating circuit, said note generating circuit including a programmable divider, said programmable divider dividing down said high frequency signal by selective division ratios to produce selected notes in respone to said note data in said memory.

11. A sound generator as claimed in claim 4, and further comprising timekeeping circuits, said timekeeping circuits providing a high frequency standard signal to said note generating circuit, said note generating circuit including a programmable divider, said programmable divider dividing down said high frequency signal by selective division ratios to produce selected notes in response to said note data in said memory.

12. A sound generator as claimed in claim 1, 2, or 4, and further comprising visible display means and means for driving said display means, said means for driving including circuit means for detecting said periods of no sound and being adapted to change said display upon the occurrence of said period of no sound, whereby said display changes in synchronization with said notes produced by said transducer.

13. A sound generator as claimed in claim 2, wherein each note signal is provided for a preselected period of time, and said note signal is further subject to inhibition for the entire selected period of time, whereby both rests and pauses may occur in the sequence of notes outputted by said transducer.

14. A sound generator comprising:

a note generating circuit for outputting a series of note signals of one or more frequencies corresponding to different audible notes;

an acoustic transducer having the series of note signals as an input and having a series of audible notes an an output;

read only memory means for storing data at a plurality of addresses, each address containing data which is characteristic of the frequency and duration of one note signal along with an inhibit signal for cutting short the duration of the note signal, the stored data being read out in an ordered sequence and the data characteristic of the frequency and duration of each note signal being fed along with the inhibit signal to the note generating circuit in the ordered sequence to produce a series of notes of full or shortened duration;

visible display means; and means for driving the display means so as to change the display produced in a predetermined sequence of visual effects, said driving means responding to each inhibit signal as it is read out in the ordered sequence, whereby the occurence of visual effects are synchronized with audible notes of shortened duration.

* * * * *